US006027111A

United States Patent [19]

Rubscha et al.

[11] Patent Number: 6,027,111

[45] Date of Patent: Feb. 22, 2000

[54] SHEET KICKBACK CONTROL SYSTEM FOR RETARD TYPE SHEET FEEDER-SEPARATOR

[75] Inventors: Robert F. Rubscha, Fairport; Mark H. Buddendeck, Farmington, both of N.Y.

[73] Assignee: Xerox Corporation, Stamford, Conn.

[21] Appl. No.: 09/034,597

[22] Filed: Mar. 2, 1998

[51] Int. Cl.[7] ..... B65H 3/52; B65H 1/00

[52] U.S. Cl. ..... 271/123; 271/161; 271/167

[58] Field of Search ..... 271/123, 145, 271/161, 167

[56] References Cited

U.S. PATENT DOCUMENTS

| | | | |
|---|---|---|---|
| 1,971,962 | 8/1934 | Jones | 271/123 |
| 2,468,842 | 3/1949 | Sporleder | 271/123 |
| 5,062,602 | 11/1991 | Kress et al. | 271/123 |
| 5,435,538 | 7/1995 | Billings et al. | 271/34 |
| 5,596,399 | 1/1997 | Dempsey et al. | 399/45 |

FOREIGN PATENT DOCUMENTS

| | | | |
|---|---|---|---|
| 185747 | 4/1988 | Japan | 271/161 |

OTHER PUBLICATIONS

IBM vol. 2 No. 3, Oct. 1959, Wheeler et al.

*Primary Examiner*—Christopher P. Ellis
*Assistant Examiner*—Kenneth W. Bower

[57] ABSTRACT

In a sheet feeding and separating system for feeding sheets downstream from a stack of sheets in a sheet stacking tray, with an sheet retard system having a sheet kickback, a sheet kickback control system comprising a high friction surface member, such as an EPDM elastomer, mounted in the sheet stacking tray extending vertically above the sheet stack supporting surface and sloping downwardly at a small angle in the downstream direction. This raised and sloping high friction surface member is positioned upstream of the sheet feeding and separating system to underlie the upstream end of the stack of sheets in the sheet stacking tray and to frictionally engage and retard upstream kickback movement of the bottom sheet of the stack of sheets by the sheet retard system.

2 Claims, 4 Drawing Sheets

SHEET KICKBACK CONTROL SYSTEM FOR RETARD TYPE SHEET FEEDER-SEPARATOR

Disclosed in the embodiment herein is a low cost and simple but effective system for reducing or preventing undesired kickback of original documents or other sheets being fed from a stack thereof in a sheet tray and separated for sequential downstream feeding by a retard type sheet feeder-separator, in which the retard system can undesirably partially kick back a sheet upstream, especially the last sheet to be fed (the bottom sheet of the stack in the case of a top feeder), which can result in that sheet not being fed or detected by a sensor.

Various types of retard type sheet feeder-separators are well known in the art. They are commonly used in many sheet feeding applications, especially in copiers, printers, document scanners, or other such reproduction apparatus, including multifunction machines. One example of a document handler for imaging documents for reproduction in which such a retard type sheet feeder-separator may be used, similar to the specification example thereof here, is disclosed in more detail in Xerox Corp. U.S. Pat. No. 5,596,399 issued Jan. 21, 1997 to Neil J. Dempsey and Mark H. Buddendeck (especially, Col. 6), and also Xerox Corp. U.S. Pat. Nos. 5,534,989 and 5,430,536.

Typically, the sheets to be separated and fed by a retard type sheet feeder-separator are initially fed from the top or bottom of the stack of sheets in the tray by an initial nudger frictional feeding roller or belt into a retard nip formed with a frictional retard pad, roller(s) or belt(s) which functions to prevent more than one sheet at a time from being fed through the retard nip (on to downstream sheet take-away rollers or the like). In an active (versus passive) retard system the retard roller(s) may be spring-loaded or otherwise reverse driven to push or kick back upstream a sheet which it engages in the retard nip while a superposed sheet in the retard nip is fed downstream through the nip by the superposed feed roller or belt defining the other side of the nip. The following patent disclosures are noted as various examples of, and further background descriptions of the operation and theory of, retard type sheet feeder-separators: Xerox Corp. U.S. Pat. No. 3,768,803 issued Oct. 30, 1973 to Klaus K. Stange; and others cited in U.S. Pat. No. 5,430,536 (supra) in Cols. 5–6, including, in particular as to those using spring reverse driven retard rolls, Savin U.S. Pat. No. 4,368,881 and Konica U.S. Pat. No. 5,039,080 to S. Kato et al.

Of particular interest as to such a retard type sheet separator feeder with a wind-up spring active (reversing) retard roller is Xerox Corp. U.S. Pat. No. 5,435,538 issued Jul. 25, 1995 to Philip A. Billings and Ermanno C. Petocchi.

It will be noted by those skilled in the art that it is well known in top feeders in general to have a small planar cork pad flush with the bottom surface of the sheet stacking tray in the area underlying the nudger roller. That cork pad is intended to engage and frictionally resist the premature feeding of the bottom sheet of the stack downstream into the retard nip when the nudger roll is engaging the top sheet of the stack to feed the top sheet downstream into the retard nip. It will be appreciated by those skilled in the art that this is not the problem, location or structure being addressed by the system here. Also known is the use of "one-way" (angled upstream) "grass" or brush fibers mounted over the rear area of the tray for a vacuum belt document feeder, to resist downstream feeding of the second-from-the-bottom sheet, as described and shown in Xerox Corp. U.S. Pat. No. 5,062,602.

A specific feature of the specific embodiment(s) disclosed herein is to provide a sheet feeding and separating system for feeding separated sheets downstream from a stack of sheets in a sheet stacking tray having a sheet stack supporting surface, wherein said sheet separating system includes an active sheet retard system downstream of said sheet stacking tray with a sheet kickback system for kicking an unseparated sheet back upstream towards said sheet stacking tray, the improvement comprising: a sheet kickback control system comprising a high friction surface member mounted in said sheet stacking tray said high friction surface member extending vertically substantially above said sheet stack supporting surface, said high friction surface member being positioned upstream of said sheet feeding and separating system to underlie the upstream end of said stack of sheets in said sheet stacking tray and to frictionally engage and retard upstream movement of the bottom sheet of said stack of sheets by said sheet kickback system.

Further specific features disclosed herein, individually or in combination, include those wherein said high friction surface member slopes downwardly at a slight angle in said downstream direction; and/or wherein said high friction surface member comprises a high friction elastomer material such as EPDM.

In reproduction apparatus such as xerographic and other copiers and printers or multifunction machines, it is increasingly important to provide faster yet more reliable and more automatic handling of the physical image bearing sheets. It is desirable to reliably feed and accurately register document and/or copy sheets of a variety and/or mixture of sizes, types, weights, materials, humidity and other conditions, and susceptibility to damage. In particular, it is desirable to minimize sheet double-feeding (mis-separations), misfeeding, skewing, jamming, wear or damage. The sheets which may be handled in or outputted from reproduction apparatus may even have curls, wrinkles, tears, "dog-ears", cut-outs, overlays, tape, paste-ups, punched holes, staples, adhesive, slippery areas, or other irregularities. Sheets can vary considerably even if they are all of the same "standard" size, (e.g. letter size, legal size, A-4, B-4, etc.). They may have come from different paper batches or have variably changed size with different age or humidity conditions, different imaging, fusing, etc.

In the description herein the term "sheet" refers to a usually flimsy physical sheet of paper, plastic, or other suitable physical substrate for images.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 1:
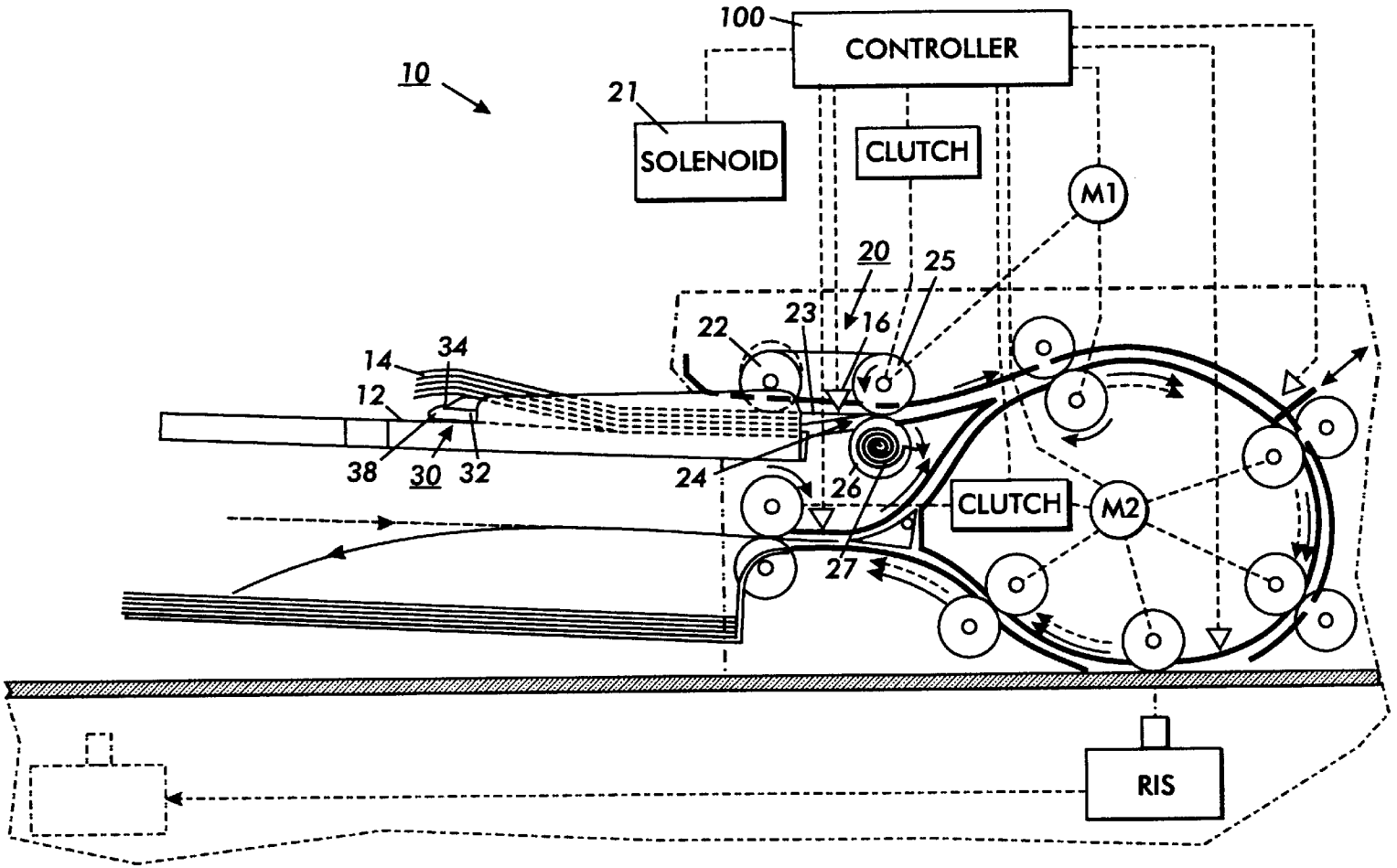
FIG. 1 is a schematic side view of one example of a sheet feeder-separator feeding document sheets into a document handling and imaging system like that of the above-cited patents thereon, with one embodiment of the subject anti-kickback system with a specially configured and positioned anti-kickback pad in the sheet tray.
Figure 5:
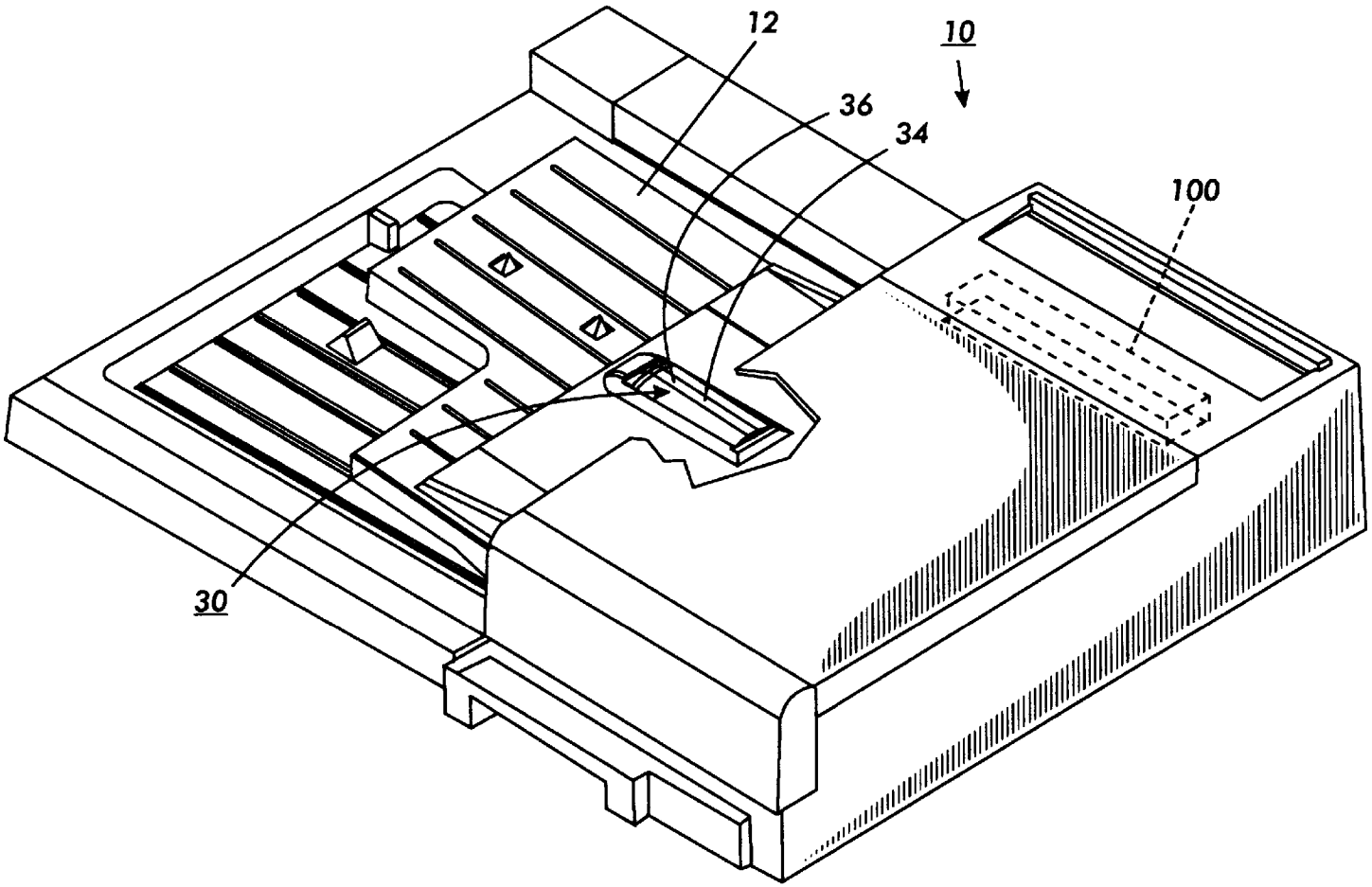
FIG. 5 is a top perspective view of the document handler of FIG. 1.

Describing now in further detail the exemplary embodiment with reference to the Figures, there is shown in FIGS. 1 and 5 a document handler 10, by way of one example of one application, in an exemplary retard type sheet feeder-separator 20, of one example 30 of the subject anti-kickback system. That anti-kickback system 30 here is shown incorporated in the input tray 12, in which the sheets 14 are stacked to be fed and separated by the associated feeder-separator 20. This example of a document handling system 10, for an imaging system, and its exemplary particular retard type sheet feeder-separator 20, are described in detail in the above-cited patents thereon, and need not be re-described in detail herein.

Briefly re-describing this known active retard type feeder-separator example 20, it may be conventionally driven by a motor M1, and when a controller 100 decides that a sheet 14 is to be fed, a solenoid 21 may temporarily lower a nudger roll 22 and its associated feed belt 23 onto the top sheet of the stack, near its front (downstream) edge, as shown, to feed that sheet (and possibly some underlying sheets) into the sheet separating retard nip 24. The retard nip 24 is formed here in this top sheet feeder 20 between an upper frictional drive roll 25 and a lower frictional retard roll 26 retarding the downstream feeding of all but the top sheet. The retard roll 26 has an integral spring 27 wound up by limited forward rotation of the retard roll 26 from engagement of the retard roll 26 by the drive roll 25 when no or only one sheet 14 is in the retard nip 24 (see, e.g., the above-cited U.S. Pat. No. 5,435,538). The spring 27 can be part of a slip clutch set to maintain a fixed torque level on the retard roller 26. When two or more sheets 14 are in the retard nip 24, the top sheet will be fed downstream by the drive roll 25 and/or feed belt 23, but the wound-up spring force on the retard roller 26 is sufficient to overcome the inter-sheet friction in the nip and reverse rotate the retard roller 26, by the spring 27 partially unwinding, so that the underlying sheet engaged by the retard roller 26 is actually pushed or kicked back upstream, out of the retard nip 24 back towards the tray 12. (The frictional force between the retard roller 26 and the bottom sheet, and the frictional force between the drive roller 25 and the top sheet, are higher than the frictional forces in between the sheets.)

An otherwise conventional sheet sensor 16 is located here just prior to (upstream of) the feed roll 25, downstream of the nudger roll 22. This sensor 16 functions as a document presence or present sensor. The document present sensor 16 is between the nudger roll 22 and the feed roll 25 in order for the controller 100 to know there are still documents in the tray 12 that the nudger 22 can "reach" and drive into the feed and retard nip 24. If the retarded and kicked-back sheet 14 is the last sheet of the stack, that last sheet may not be detected if it is kicked back upstream beyond the document presence sensor 16. The resultant no-sheets-present signal from sensor 16 can result in a set or job integrity problem if the machine logic thinks that all of the documents in the input tray have been fed, when they have not.

That error could be avoided if there were added another, in-tray, document presence sensor. However, besides the added cost of adding another sensor, sensors within the tray are exposed, and more subject to being jammed or actuated accidentally. Putting a fixed sheet rear end stop in the tray to prevent excessive sheet kickback is not a suitable solution since it would not allow for different or intermixed sheet lengths.

The distance between the nudger roll 22 and feed roll 25 is desirably short. Thus, the distance or spacing for the sensor 16 and its sheet kickback tolerance distance is also short. Thus, although here sheets are not kicked back upstream beyond the range of the nudger roll 22, the last sheet may be kicked back beyond the sensing range of the document present sensor 16. Note that kickback of sheets prior to the last sheet is not a problem. Those sheets are still fed without any controller confusion or set integrity problem because the last sheet is still occluding and tripping sensor 16.

Figure 2:
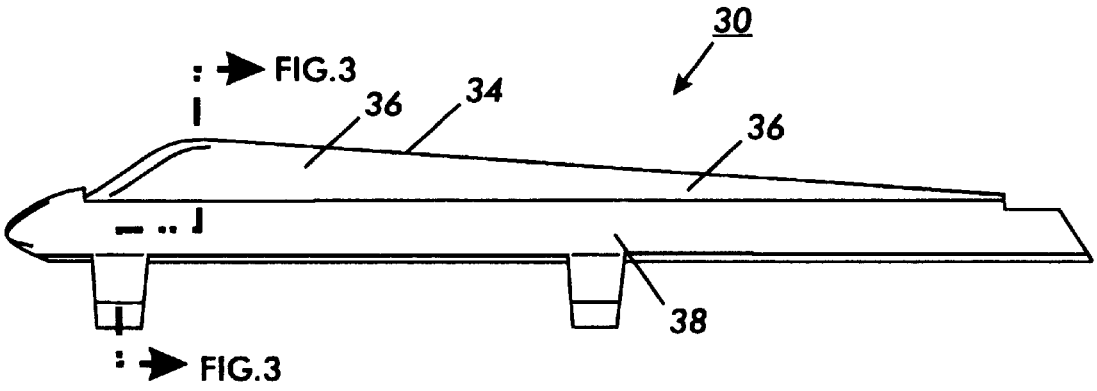
FIG. 2 is a side view of the anti-kickback pad of FIG. 1 per se.
Figure 3:
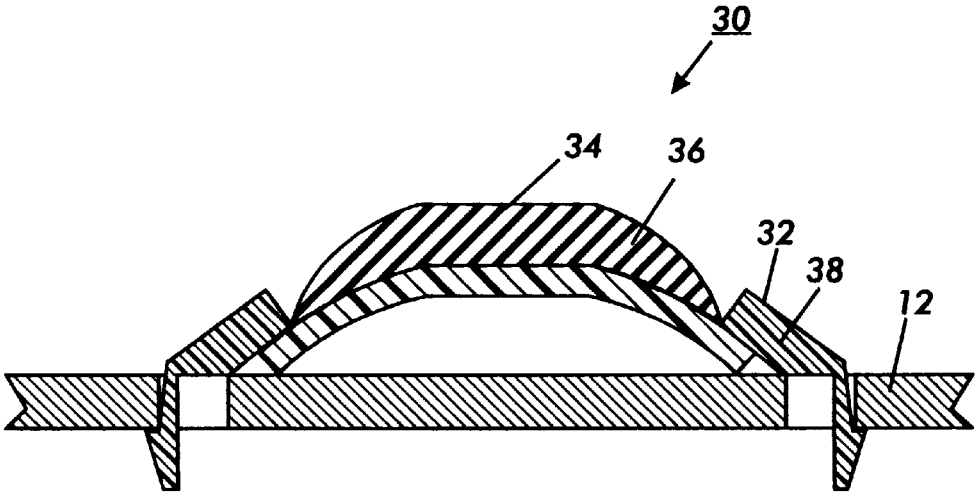
FIG. 3 is a cross-sectional view taken along the line 3—3 of FIG. 2.
Figure 4:
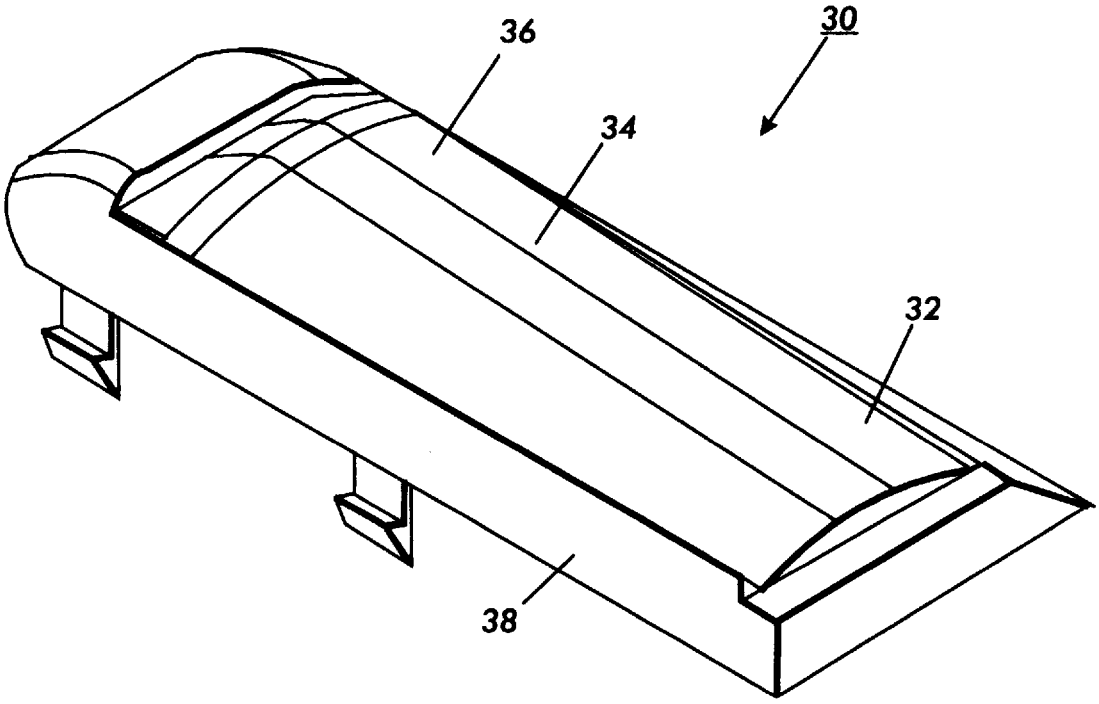
FIG. 4 is a perspective view of the anti-kickback pad of FIGS. 1, 2 and 3.

Turning now to the exemplary anti-kickback system 30 also shown here, it may be seen that it comprises a module 32 mounted in the sheet stacking tray 12 in a defined position in the tray, substantially upstream of the sheet engagement area of the nudger roll 22, and the rest of the feeder-separator 20. The module 32 may even be a simple snap-in unit, such as that particularly shown per se in FIGS. 2–4, mounting to small apertures in the tray 12 as particularly shown in FIG. 3. The module 32, as mounted, has a specially configured upper surface 34, as shown, extending above the surface of the tray 12 to specially engage an upstream area of the bottom sheet 14 of the stack of sheets loaded in the tray 12 for feeding. I.e., elevated above the tray 12 sheet retaining and supporting surface to insure frictional contact with the bottom sheet 14. It is positioned to underlie a standard size sheet stack, as shown in FIG. 1, and configured to add frictional resistance to the upstream or reverse feeding of the bottom sheet (opposite to the desired sheet feeding direction out of the tray). That sheet engagement surface 34 is provided by a pad 36 of highly frictional material, such as EPDM elastomer. The pad 36 may be mounted in, supported by, and surrounded by at its base, by a plastic housing 38 with smoothly arcuate transitioning surfaces (as shown) to avoid stubbing documents being loaded into the tray 12. This EDPM pad 36 exhibits a high coefficient of friction to paper. EPDM is a suitable available material for that purpose, and is known for sheet friction feeder drive rolls and wide friction belts in copiers and printers.

In this example, the pad 36 height at the upstream, rear or trail edge of the pad extends approximately 6.2 mm. from the tray surface, versus about 2 mm for the front of the pad. The pad 36 surface is thus preferably not parallel to the tray surface, since that was found to not provide enough contact surface with the last document in the tray for severe sheet kick-back conditions. Thus, the major portion of the pads EPDM material upper surface is preferably angled slightly (about 2.24 degrees)—sloping downwardly downstream. The raised rear or upstream end of the pad 36 then curves back down towards the tray surface, as shown, to round or shield all the edges of the pad 36, to prevent sheet stubbing against the pad while loading the sheets into the tray. The pad 36 thus has two angled surfaces. The first or upstream angle in the feed direction functions to retard the last or bottom sheet from being pulled into the feed-retard nip zone during feeding of the overlying sheets, the sheets which are above it, or the second-to-last sheet. If the bottom sheet can be prevented from entering the retard zone, it will not be kicked back. The second angle, the one sloping downwardly towards the tray surface in the direction of feed, acts to retard the sheet if kickback does occur.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet feeding and separating system for feeding separated sheets downstream from a stack of sheets in a sheet stacking tray having a sheet stack supporting surface, wherein said sheet separating system includes an active sheet retard system downstream of said sheet stacking tray with a sheet kickback system for kicking an unseparated sheet back upstream towards said sheet stacking tray, the improvement comprising:

a sheet kickback control system comprising a high friction surface member mounted in said sheet stacking tray said high friction surface member extending vertically substantially above said sheet stack supporting surface, said high friction surface member being positioned upstream of said sheet feeding and separating system to underlie the upstream end of said stack of sheets in said sheet stacking tray and to frictionally engage and retard upstream movement of the bottom sheet of said stack of sheets by said sheet kickback system and wherein said high friction surface member comprises a high friction elastomer material such as EPDM.

2. The sheet feeding and separating system of claim 1, wherein said high friction surface member slopes downwardly at a slight angle in said downstream direction.

* * * * *